US006342102B1

(12) United States Patent
Hartman et al.

(10) Patent No.: US 6,342,102 B1
(45) Date of Patent: Jan. 29, 2002

(54) APPARATUS AND METHOD FOR INCREASING THE DIAMETER OF METAL ALLOY WIRES WITHIN A MOLTEN METAL POOL

(75) Inventors: Alan D. Hartman; Edward R. Argetsinger, both of Albany; Jeffrey S. Hansen, Corvallis; Jack I. Paige, Albany; Paul E. King, Corvallis; Paul C. Turner, Independence, all of OR (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 0 days.

(21) Appl. No.: 09/593,211

(22) Filed: Jun. 14, 2000

(51) Int. Cl.[7] ..... B05C 3/00
(52) U.S. Cl. ..... 118/405; 118/424
(58) Field of Search ..... 164/461; 118/404, 118/405, 424, 423

(56) References Cited

U.S. PATENT DOCUMENTS 3,978,815 A 9/1976 Carrara
3,995,587 A 12/1976 Carrara
3,995,679 A 12/1976 Brinkman et al.

*Primary Examiner*—Brenda A. Lamb
(74) *Attorney, Agent, or Firm*—Bradley W. Smith; Mark P. Dvorscak; Virginia B. Caress

(57) ABSTRACT

In a dip forming process the core material to be coated is introduced directly into a source block of coating material eliminating the need for a bushing entrance component. The process containment vessel or crucible is heated so that only a portion of the coating material becomes molten, leaving a solid portion of material as the entrance port of, and seal around, the core material. The crucible can contain molten and solid metals and is especially useful when coating core material with reactive metals. The source block of coating material has been machined to include a close tolerance hole of a size and shape to closely fit the core material. The core material moves first through the solid portion of the source block of coating material where the close tolerance hole has been machined, then through a solid/molten interface, and finally through the molten phase where the diameter of the core material is increased. The crucible may or may not require water-cooling depending upon the type of material used in crucible construction. The system may operate under vacuum, partial vacuum, atmospheric pressure, or positive pressure depending upon the type of source material being used.

10 Claims, 3 Drawing Sheets

APPARATUS AND METHOD FOR INCREASING THE DIAMETER OF METAL ALLOY WIRES WITHIN A MOLTEN METAL POOL

U.S. GOVERNMENT RIGHTS

The United States government has rights in this invention pursuant to the employer-employee relationship of the Government to the inventors as U.S. Department of Energy employees at the Albany Research Center.

BACKGROUND OF THE INVENTION

This apparatus and method are an improvement in the dip forming process for increasing the diameter of metal wire or rods. The dip forming process is sometimes referred to in the prior art as a form of coating or casting. Casting usually implies the use of a die. However, "casting" is known in the art to also mean producing a metallic object with a preferred shape by running it through a molten bath and allowing the molten metal to solidify on the initial metal wire or rod. The present apparatus includes a block of metal that will be used as the coating material (referred to as the "source block of coating material") to add diameter to the metal wire or rods (referred to as "core material"). The source block of coating material is housed within a hollow receptacle (known in the art as a "vessel" or "crucible") and machined to include a hole that closely fits the core material that will pass through the block of coating material. The apparatus includes heating elements positioned on the exterior of the crucible such that only the upper portion of the source block of coating material housed within it will become molten while the heating elements are active and the lower portion of the source block will remain solid. The exact position of the heating elements on the crucible will vary with the size and dimensions of both the crucible and the source block, as well as with the amount of energy supplied to the heating elements.

The method includes passing the core material to be coated upward through the machined hole in the source block of coating material. The source block of coating material is located within the crucible and during operation exists in three physical states: (1) solid, in the base region of the source block of coating material where a machined channel or hole closely fits the core material; (2) solid/molten metal interface, where the core material and the molten metal from the source block converge; and (3) molten metal from the source block, for coating the core material as it moves upward through the crucible.

The core material passes upward through the machined hole within the solid portion of the source block of coating material before it contacts the molten metal that will coat the core material. A problem with the dip forming process is that small particles become entrained on the core material and form inclusions in the coated product or contaminate the molten coating material. This problem is eliminated in the subject apparatus where the closeness of fit between the core material and the hole machined within the source block of coating material provide a guide and seal to eliminate this problem. This seal prevents the core material from entering the crucible with entrained particles that may result in inclusions in the coated product or contamination of the molten metal used in the coating process.

The prior art has solved the problem of small particle entrainment by use of a bushing member to seal the entrance port for the core material. Use of such a bushing member has introduced new problems with the process. The dip forming processes have required that the bushing member be of different composition than the molten metal as described in U.S. Pat. No. 3,995,587 and other U.S. Patents referenced therein.

The closeness of fit between the solid portion of the source block and the core material is intended to serve the purpose of the bushing used in the prior art. The fit should be close enough to remove small particles that may become entrained on the core material and close enough to prevent the molten metal from entering the hole in the source block while the core material moves through the dip form processing apparatus, but not so close as to bind the core material within the source block.

When the bushing has a different metal composition relative to the metal that is used to coat the core material, the integrity of the process is at risk. Reactive metals, such as titanium and zirconium, readily dissolve other metals. Reactive metals used to coat the core material may dissolve the bushing on contact and may compromise the structural integrity of the crucible. The bushing otherwise effects the structural integrity of the crucible by being subject to physical wear by the moving core material. The bushing member is embedded in the vessel or crucible bottom and thus affects the ability of the crucible to hold molten metal over time. When the bushing member breaks down in the presence of reactive metals it becomes a new source of inclusions on the core material and a new source of contamination of the coating material.

The present apparatus and method avoid problems with the bushing by using the closeness of fit between the core material and the source block of coating material to prevent entrainment of small particles on the core material. Closeness of fit coupled with steady movement of the core material through the apparatus prevents the molten metal coating material from leaking out of the crucible.

OBJECTS OF THE INVENTION

The primary object of this invention is to provide a method for increasing the diameter of core material that does not require a bushing member at the entrance port of the crucible in order to eliminate the break down of such members particularly when reactive metals are used and to avoid the subsequent entrainment of particles within the cast product.

Another object of this invention is to provide an apparatus to allow the elimination of a bushing member from the entrance port of the crucible by utilizing a solid portion of the coating material as a guide and seal at the entrance port for the core material.

Another object of this invention is to heat and melt only the top portion of the source block material creating a source block/core material interface while the bottom portion of the source block remains solid.

SUMMARY OF THE INVENTION

This apparatus and method are an improvement for increasing the diameter of core material, such as metal and alloy wire and rods, by use of a molten metal pool. The method encompasses the startup and batch, intermittent, or continuous operation of coating and casting to increase diameters of core materials, especially for applying reactive metal coatings. The core material is moved upward through a source block of coating material. The invention eliminates the need for a bushing member at the entrance port and, thus, eliminates potential contamination and molten metal sealing problems due to bushings.

During operation the source block of coating material serves as: (1) a solid component core material entrance guide; (2) the solid/molten interface; and (3) the molten metal coating material. The invention is especially applicable for coating and increasing the diameter of reactive metal wire and rods because the same composition reactive metal source coating block material is used as the wire entrance guide, seal, and molten metal source for wire coating. The invention is applicable for cold-wall copper crucibles (both bottomless and casting crucibles with bottoms), ceramic crucibles, or any other containment crucible appropriate for the type of metal or alloy being melted. The system can be under vacuum, partial vacuum, atmospheric pressure, or positive pressure that is appropriate for the metal or alloy being melted.

DETAILED DESCRIPTION OF THE PREFERRED EMBODIMENT

Figure 1:
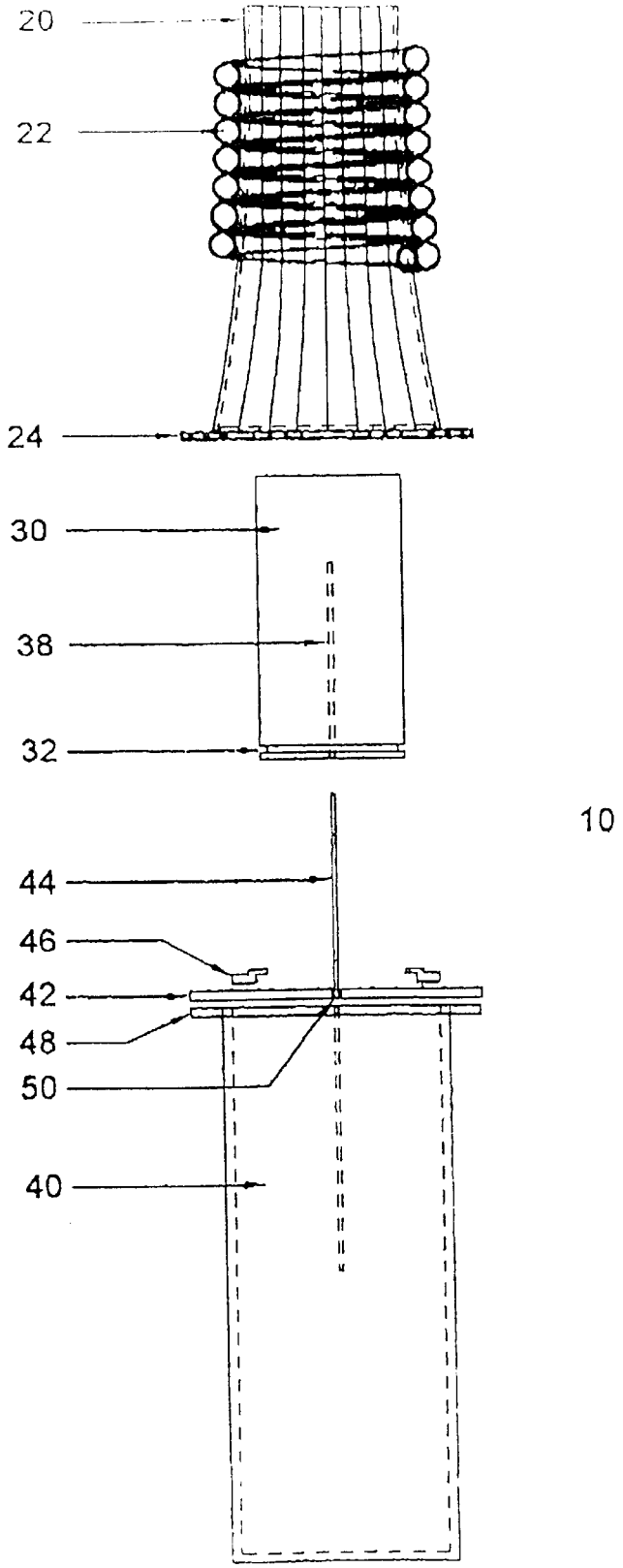
FIG. 1 is an exploded view of the invention.

The component configuration in FIG. 1 is an exploded view of the preferred embodiment for an apparatus to increase the diameter of metal and alloy wire or rods ("core material") by passing the core material through molten metal. The dip forming apparatus 10 consists of a crucible 20 that is a hollow, segmented water-cooled copper crucible. This particular embodiment includes water channels (not shown) through which water circulates within the crucible to assist with temperature control. However, the apparatus and method are applicable to dip forming processes that do not utilize water-cooled crucibles or vessels. The crucible 20 shown in FIG. 1 is tapered from the bottom of the crucible 20 to the top such that the circumference at the top is smaller than the bottom circumference. An induction coil 22 is wrapped around the outer surface of the upper portion of the crucible 20. A source block of coating material 30 is shown beneath the crucible 20 and during operation of the dip forming process, the source block 30 is contained within the crucible 20. The slightly larger bottom circumference relative to top circumference prevents the source block material 30 from being lifted out of the crucible 20.

The crucible, vessel or receptacle 20 shape may also be rectangular, spherical or another shape. The main concern should be that the source block 30 cannot be lifted up and out of the crucible 20 during operation. In addition to the crucible restraint, a groove 32 around the bottom end of the source block 30 locks into a bracket 46 on top of a plate shelf 42 at the top end of the chamber 40 and serves to hold the source block of coating material in place. In the preferred embodiment the plate shelf 42 and brackets 46 form a continuous piece. However, the brackets 46 may be separate from and moveable upon the plate shelf 42. With such a groove 32 and bracket 46 relationship, the top circumference of the crucible 20 does not need to be smaller than the bottom circumference in order to retain the source block 30.

Located beneath the source block 30 is a bottom chamber 40 that houses the core material 44 to be coated. The crucible 20 has a flange 24 at its lower end. This flange 24 mates with a bottom chamber 40 section flange 48 in line with a plate shelf 42 containing a center aperture 50. The plate shelf 42 is a separate component from the bottom chamber 40 for ease of maintenance and assembly and is bolted to the bottom chamber 40. The center aperture 50 allows the core material 44 to enter the crucible 20 from the chamber 40 into a machined hole 38 in the source block 30 of coating material.

The preferred embodiment uses induction coils 22 as a heating mechanism for the dip forming process. However, this apparatus is amenable to the use of other heating methods such as electron beam or plasma melting devices being similarly situated, but focusing down into the top of the crucible 20. The preferred embodiment also uses a segmented water-cooled copper crucible. The apparatus may include the use of casting crucibles with bottoms or a bottomless ceramic crucible for ease of operation and to retain the source material 30. The apparatus is also amenable to use with crucibles that do not require water-cooling such as yttrium oxide crucibles with a tungsten layer.

Figure 2:
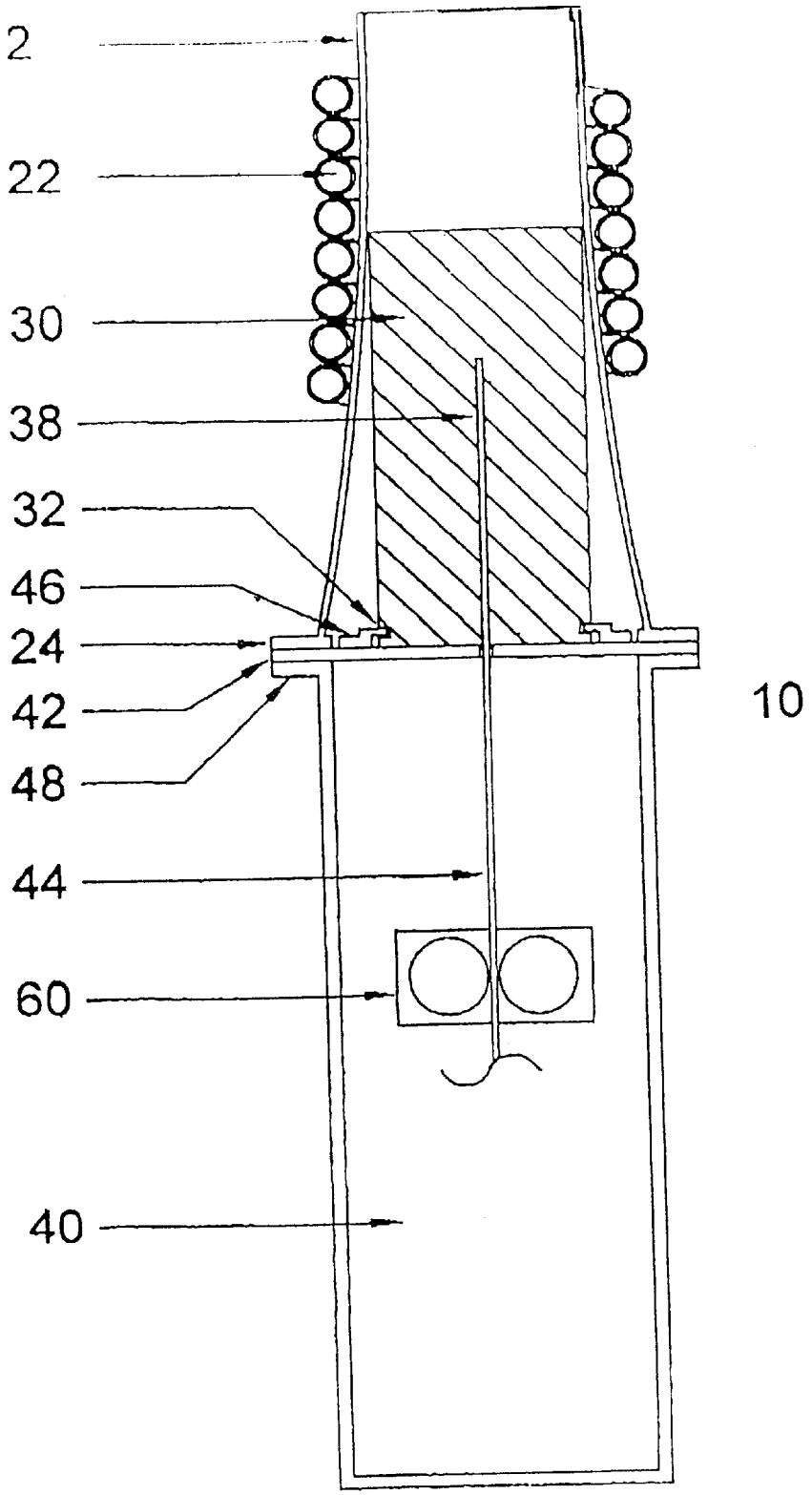
FIG. 2 is a cross-sectional view of the assembled components.

System setup: Referring to FIG. 2, a source block 30 of coating material has a circumference larger than the circumference of the top of the crucible 20. The source block 30 enters the crucible 20 through the base of the crucible 20, where the circumference is larger than that of the source block 30. This arrangement prevents the source block 30 from being lifted out of the crucible 20 during operation. The source block 30 has a hole 38 that is machined to the size and shape of the core material 44 to produce a close tolerance fit between the source block hole 38 and the particular core material 44 to be processed. The source block hole 38 need not extend the entire length of the source block 30 because the upper portion of the source block 30 will become molten allowing the core material 44 to be easily pushed through the crucible 20. The core material 44 is embedded within the source block hole 38. The source block 30 is positioned within the crucible 20 such that when the induction coils 22 are activated, the upper part of the source block 30 will melt to form a molten metal region extending from the top of the source block to the upper portion of the embedded core material 44. The upper portion of the embedded core material 44 is then surrounded by the molten metal within the source block as the molten metal fills the gap between the source block 30 and the interior of the crucible 20.

Once the source block 30 is positioned inside the crucible 20, brackets 46 attached to the plate shelf 42 are inserted into a groove 32 of the source block 30. The crucible 20 is secured to the chamber 40 by connecting flanges 24 and 48 on the crucible 20 and bottom chamber 40. The core material 44 is contained within the chamber 40 and an end is inserted through the plate shelf aperture 50 and into the hole 38 in the source block 30. An appropriate upward force is maintained on the embedded core material 44 by commonly available single or variable speed drive rolls, pinch rolls, or equivalent mechanisms 60 located within or outside the bottom chamber 40. The upward force is maintained at a level that is sufficient to drive the core material 44 up and out of the containment crucible 20 once the core material 44/block 30 interface becomes molten.

Figure 3:
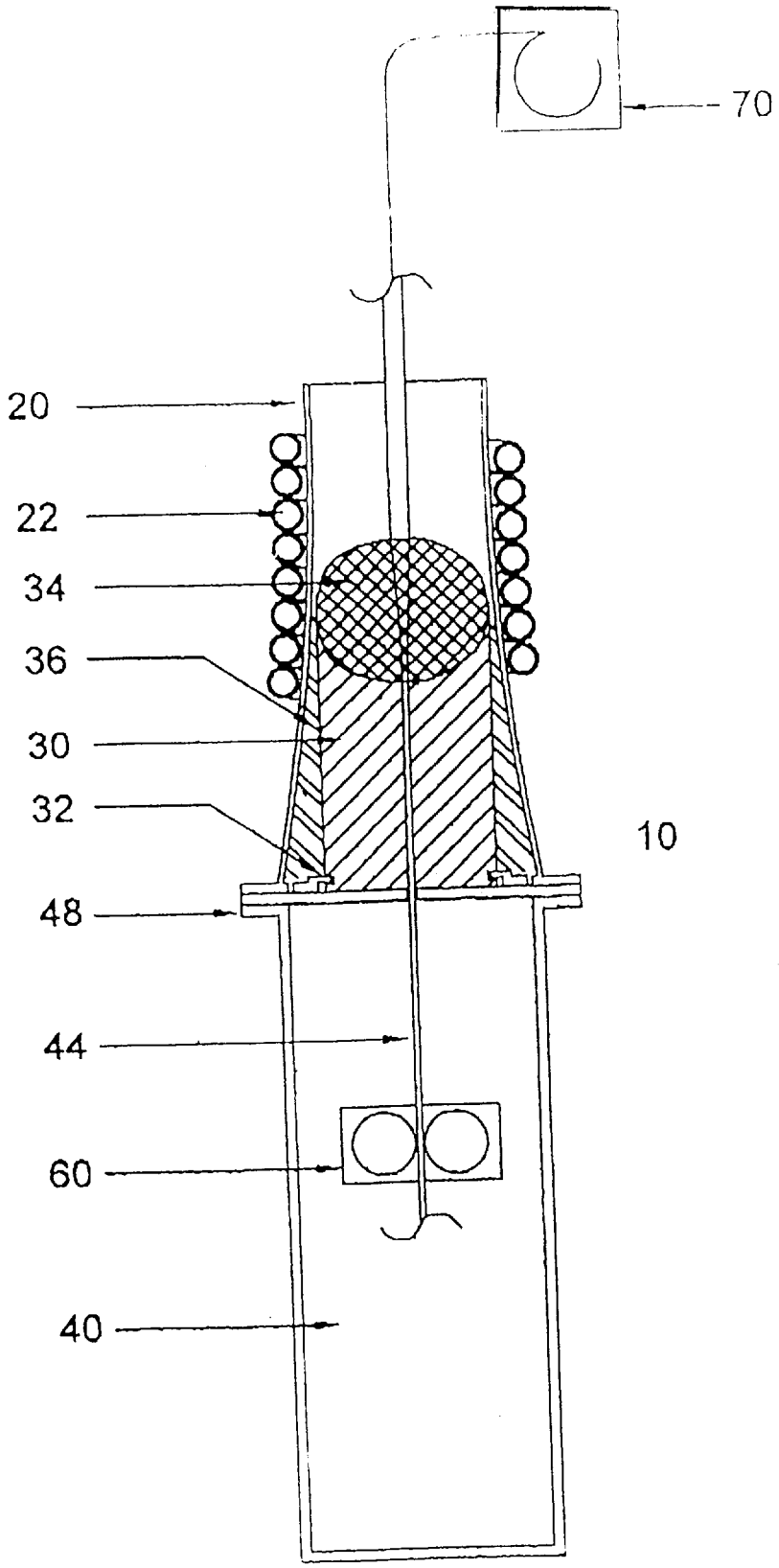
FIG. 3 is a cross-sectional view of the apparatus during operation.

Operation: FIG. 3 more clearly shows the internal configuration of metal phases while the dip form process is in operation. The induction coils 22 are positioned outside the crucible 20 so that the top portion of the source block 30 is heated. The dip form processing apparatus 10 is configured so that only the upper portion of the source block 30 becomes molten while the lower portion intentionally remains solid. As the upper portion of the source block 30 becomes molten 34 it flows down around the outside of the unmelted portion of the solid block 30. This melting and subsequent flowing around the unmelted portion produces a solidified layer 36 that conforms to the inner surface of the crucible 20. The solidified layer 36 widens the base of the source block 30 and further prevents the source block 30 from being lifted out of the crucible 20 should the core material 44 become stuck to the source block 30.

The closeness of fit between the core material 44 and the hole 38 in the source block 30 prevents the molten metal 34 from falling through the aperture and into the chamber 40. Molten metal is further prevented from falling through the hole 38 in the source block 30 by initially positioning the core material 44 as far into the source block 30 as the hole 38 extends. An upward force is maintained on the core material 44 by conventional means such as a pinch roller system 60 to facilitate the initial push through the molten metal 34 once the interface between the source block 30 and the core material 44 becomes molten. This upward movement will tend to keep the molten metal 34 from entering into the space occupied by the embedded core material 44. As the molten region 34 becomes established and encompasses the core material 44 and source block 30 interface, the core material 44 proceeds through the molten metal region 34 of the melt, molten metal 34 from the melt solidifies on the surface of the core material 44 forming a coating which increases its diameter. The speed at which the core material 44 travels through the molten metal 34 is varied to attain the desired increase in diameter.

The system is large enough to facilitate continuous charge feeding and continuous coated core material 44 withdrawal. When rods are to be coated, the process may be batch, intermittent, or continuous limited only by the length of rod to be coated. The coated core material 44 is collected at the top end of the dip forming apparatus 10 by conventional means such as a pinch roller system or drum assembly for a coiled product 70. The whole system can be under vacuum, partial vacuum with an inert atmosphere, or atmospheric pressure depending on the type of metal being melted, and can be run continuously, intermittently, or batchwise.

What is claimed is:

1. Apparatus for dip forming process, comprising:

a hollow receptacle that is open at both ends;

a bottom chamber housing a core material that is a metal or alloy wire or rod to be coated where said bottom chamber is positioned below and fastened to said hollow receptacle;

a solid source block of metal coating material positioned inside said hollow receptacle said solid block of metal coating material having a hole machined therein of a size and shape to closely fit said core material to be coated and where said core material extends directly from said bottom chamber into the hole machined in said solid block of metal coating material;

a means for securing said solid block of metal coating material within said receptacle;

a means for heating an upper portion of said receptacle such that an upper portion of said solid block of metal coating material therein will become molten while a lower portion of said solid block of metal coating material; will intentionally remain solid; and a means for moving said core material from said bottom chamber into said hole machined within said solid block of metal coating material.

2. The apparatus of claim 1 wherein said means for heating an upper portion of said receptacle is an induction coil.

3. The apparatus of claim 1 wherein said means for heating an upper portion of said receptacle is an electron beam.

4. The apparatus of claim 1 wherein said means for heating an upper portion of said receptacle is a plasma heating device.

5. The apparatus of claim 1 wherein said means for moving said core material is a single or variable speed pinch roll.

6. The apparatus of claim 1 wherein said means for moving said core material is a single or variable speed drum assembly.

7. The apparatus described in claim 1 wherein the means for securing said solid block of metal coating material within said receptacle is a plate shelf having a hole defined therethrough and aligned with said machined hole in said solid block of metal coating material ; and a groove surrounding a lower end of said solid block of metal coating material where said groove is coupled to a bracket located on said plate shelf.

8. The apparatus described in claim 7, further comprising:

a roller assembly to collect said core material at the top of said receptacle after said core material has been processed.

9. The apparatus of claim 8 wherein said roller assembly is a pinch roller system or drum assembly.

10. The apparatus described in claim 1 wherein the means for securing said solid block of metal coating material is a smaller upper receptacle perimeter or circumference relative to the perimeter or circumference of said solid block of metal coating material.

* * * * *